US005182605A

United States Patent [19]

Yamada et al.

[11] Patent Number: 5,182,605

[45] Date of Patent: Jan. 26, 1993

[54] XEROGRAPHIC PRINTING MACHINE WITH AN IMPROVED TRANSFER UNIT

[75] Inventors: Masato Yamada; Junji Shirakawa; Kazuo Uno, all of Ibaraki, Japan

[73] Assignee: Hitachi Koki Co. Ltd., Tokyo, Japan

[21] Appl. No.: 800,090

[22] Filed: Nov. 29, 1991

[30] Foreign Application Priority Data

Nov. 30, 1990 [JP] Japan ..... 2-337659

[51] Int. Cl.[5] ..... G03G 15/16

[52] U.S. Cl. ..... 355/274; 250/325; 361/225

[58] Field of Search ..... 355/217, 271, 274, 275, 355/276, 277, 281; 361/225, 230, 233; 250/324–326

[56] References Cited

U.S. PATENT DOCUMENTS

| | | | |
|---|---|---|---|
| 3,966,199 | 6/1976 | Silverberg | 355/217 X |
| 4,114,536 | 9/1978 | Kaneko et al. | 355/277 |
| 4,849,795 | 7/1989 | Spehrley, Jr. et al. | 355/271 X |
| 5,027,159 | 6/1991 | Oda et al. | 355/271 |
| 5,061,967 | 10/1991 | Isobe | 355/271 X |

FOREIGN PATENT DOCUMENTS

| | | | |
|---|---|---|---|
| 0154775 | 11/1981 | Japan | 355/271 |
| 0083778 | 4/1988 | Japan | 355/271 |

*Primary Examiner*—A. T. Grimley
*Assistant Examiner*—William J. Royer
*Attorney, Agent, or Firm*—Sughrue, Mion, Zinn, Macpeak & Seas

[57] ABSTRACT

A xerographic printing machine with at least two rollers disposed so that their axes are arranged parallel to each other. An endless belt, supported by the rollers, has a volume resistance within the range of $10^9$ to $10^{14}$ Ωcm. A photoreceptor is disposed adjacent to the endless belt. An endless belt charging device is disposed opposed to the photoreceptor in such a way that the endless belt is located between the endless belt charging device and the photoreceptor. An electrostatically charged toner supported on the surface of the photoreceptor is transferred to a print media. A guide member is disposed between the photoreceptor and the roller located upstream of the endless belt as viewed in the advancing direction of the endless belt. The guide device guides the advancing print media to bring the print media into contact with the endless belt.

4 Claims, 4 Drawing Sheets

XEROGRAPHIC PRINTING MACHINE WITH AN IMPROVED TRANSFER UNIT

BACKGROUND OF THE INVENTION

1. Field of the Invention

The present invention relates to a xerographic printing machine, and more particularly, to an improved transfer unit for a xerographic printing machine.

2. Description of the Related Art

In conventional xerographic printing machines, a transfer system, based on corona discharge, has been used for transferring a toner image formed on a photoreceptor to a print medium. This type of transfer system is disadvantageous in that under conditions of high humidity, the image transfer performance is poor. This is so because dust and other debris accumulate on the corona wire or corrugation of the print media occurs. To overcome this, it has been proposed to utilize a transfer system of the corona discharge type, in which the print media is pressed against a photoreceptor by a material having a volume electrical resistance of $10^9$ to $10^{14}$ Ω cm. However, this type of system can be disadvantageous because often the print media cannot be easily peeled from the photoreceptor. This will be described with reference to FIGS. 3, 4, and 5.

In FIG. 3, endless belt 1 is stretched, at a preset tensile force, around drive roller 2 and follower rollers 3 and 5, so as to press paper 15 against photoreceptor 8. FIG. 4 illustrates how a stack of papers 15, used as print medium, is cut during processing. When normal thin papers 15 are cut, several sheets of papers are stacked and cut. Accordingly, burr 16 may be created at the edge of stacked papers 15 after cutting, as shown in FIG. 4. The height of burr 16 often reaches several tens of μm or more. When paper 15, having burr 16, is transferred in a state such that burr 16 of the paper is curved toward belt 1, paper 15 fails to peel off photoreceptor 8.

FIG. 5(*a*) is a graph showing the Paschen curve (indicated by a solid line) under atmospheric pressure, and typical gap-voltage vs. gap width curves (indicated by dotted lines) between two dielectric sheets with fixed quantities of charge. The graph is referred to in "ELECTROPHOTOGRAPHY", written by R. M. Shaffert and will be described below.

In the contact part (referred to as a nip part) of photoreceptor 8 and endless belt 1, paper 15 with burr 16 lies as shown in FIG. 5(*b*). As shown, gap 17 is formed between endless belt 1 and paper 15 by virtue of the presence of burr 16. As shown in FIG. 5(*a*), the potential difference Va+Vc between endless belt 1 and photoreceptor 8, and acting across gap 17, increases with an increase in the width of gap 17. Va is the voltage applied to endless belt 1, and Vc is the voltage on photoreceptor 8. These voltages are opposite in polarity so as to cause paper 15 to adhere to endless belt 1. When the gap voltage exceeds the Paschen curve, discharge occurs in gap 17, thus charging the leading edge of paper 15 with a positive charge. Consequently, paper 15 and photoreceptor 8 electrostatically attract each other and, when passing through the nip part, the paper is separated from endless belt 1, while sticking to photoreceptor 8.

After the leading edge of paper 15 sticks to photoreceptor 8, a minute gap is continuously formed between endless belt 1 and paper 15 at the releasing zone of the nip part, with rotation of photoreceptor 8 and endless belt 1. Accordingly, discharge continues in the gap between endless belt 1 and paper 15, so as to positively charge all of paper 15. This results in difficulty in separating paper 15 from photoreceptor 8.

When paper 15 is fed to the nip part along the surface of photoreceptor 8, even if the paper has no burr 16 at the edge or is located on photoreceptor 8 so that burr 16 is outcurved toward photoreceptor 8, a minute gap is continuously formed between belt 1 and paper 15 at a location immediately before the nip part. Accordingly, discharge occurs in the minute gap, and the above-mentioned paper peel-off failure occurs. To prevent peel-off failure, a conventional technique reduces the diameter of photoreceptor 8 or additionally uses a claw to separate paper 15 from photoreceptor 8.

SUMMARY OF THE INVENTION

The present invention has been made in view of the above circumstances and has an object to provide a xerographic printing machine which prevents a print media, even if it has a burr at the leading edge, from sticking to the surface of the photoreceptor without reducing the diameter of the photoreceptor or without the use of a claw to separate the paper from the photoreceptor.

To achieve this object, the invention has at least two rollers, disposed with their axes of rotation arranged parallel to each other, and an endless belt supported by the rollers. The volume electrical resistance of the endless belt is within the range of $10^9$ to $10^{14}$ Ω cm. A photoreceptor is disposed adjacent to the endless belt, and an endless belt charging means is disposed opposite to the photoreceptor so that the endless belt is located between the endless belt charging means and the photoreceptor. An electrostatically charged toner supported on the surface of the photoreceptor is transferred to a print media. A guide for directing the motion of the print media is disposed between the photoreceptor and the roller located upstream of the endless belt, as viewed in the advancing direction of the endless belt. The guide directs the advancing print media into consistent contact with the endless belt. The edge of the guide, which is closer to the photoreceptor, is in contact with the surface of the endless belt.

The endless belt charging means is disposed so that a phantom line, connecting the center of the endless belt charging means to the center of the photoreceptor, is positioned in the region ranging from a start point of the contact part of the photoreceptor and the endless belt, where the photoreceptor and the endless belt start to contact with each other, to the center of the contact part. A contact point of the guide means and the endless belt lies in the region where an electric field for image transfer acts on the endless belt charging means.

Other objects, features, and advantages of the invention will be apparent when carefully reading the detailed description to follow in connection with the accompanying drawings.

BRIEF DESCRIPTION OF THE DRAWINGS

FIG. 5(*b*) is a sectional view mainly showing a nip part where burred paper is nipped between the photoreceptor and the endless belt;

FIG. 5(*c*) is a sectional view mainly showing a nip part useful in explaining the present invention; FIG. 6(*b*) shows diagrams showing a case where the paper is separated from the lower electrode, while it remains sticking to the upper electrode.

DETAILED DESCRIPTION OF THE PREFERRED EMBODIMENT

Figure 6A:
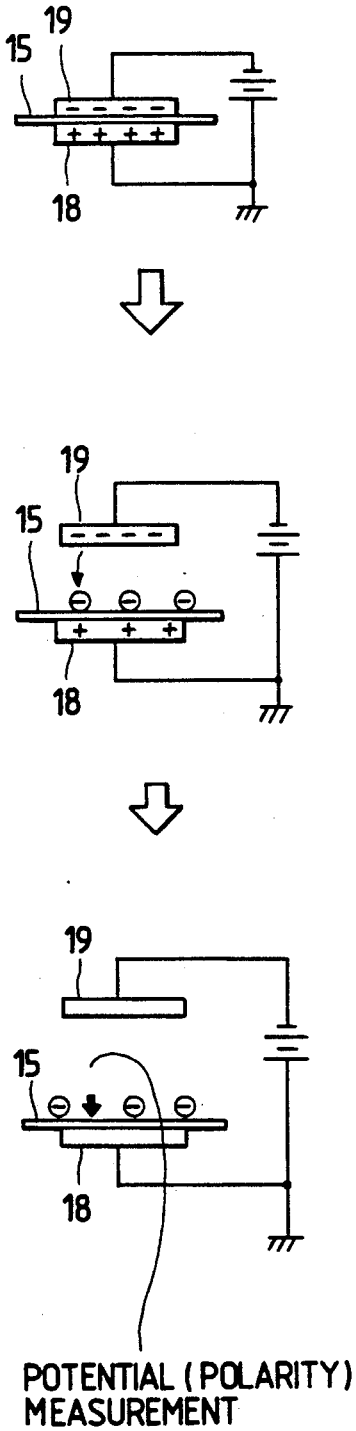
FIG. 6(*a*) shows diagrams useful in explaining an experiment to examine the charging characteristic of the paper when it is released from being nipped, the diagrams showing a case where the paper is separated from the upper electrode, while it remains sticking to the lower electrode.

Before proceeding with the description of a preferred embodiment of the present invention, the charging characteristic of paper when it is released from being nipped will be described with reference to FIG. 6. FIG. 6 is useful in explaining an experiment to examine the above-mentioned charging characteristic. In the experiment, paper 15 was held between a pair of electrodes 18 and 19. After a voltage was applied across electrodes 18 and 19, the charge polarity of paper 15 was examined.

Figure 6B:
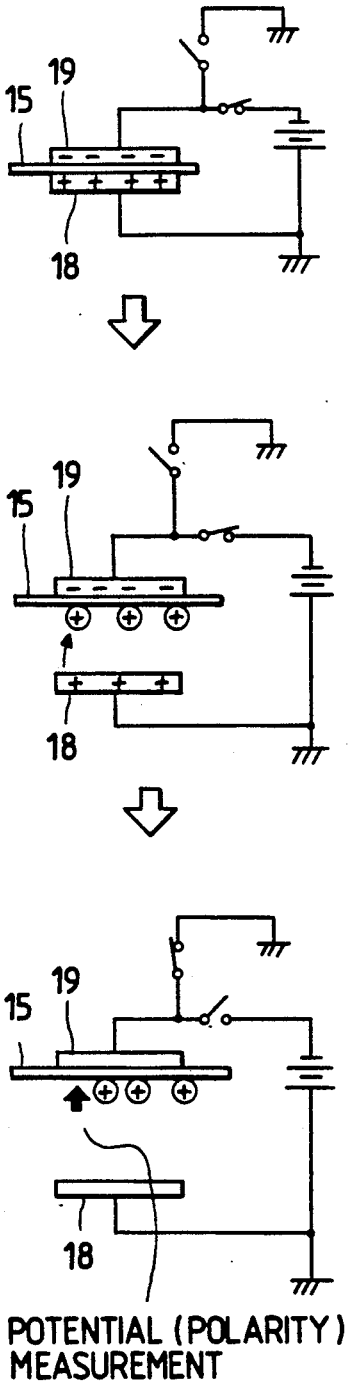

FIG. 6(*a*) shows a case where the paper is separated from electrode 19 while remaining stuck to electrode 18. Diagrams of FIG. 6(b) show a case where the paper is separated from electrode 18 while sticking to electrode 19. As seen from these figures, paper 15 is negatively charged in the case of FIG. 6(*a*). The polarity of charged paper 15 depends on the electrode, which was in contact with the paper per se, and is inverted when the electrode is switched. This is due to the fact that above a certain value of potential difference between electrodes 18 and 19, gap discharge occurs in the gap which is the larger of the two and thus paper 15 is charged. The gap discharge in the process where the paper is released has been described above. The same thing is true for the process where the electrodes gradually clamp the paper.

Let us apply the results of the experiment to the construction of photoreceptor 8, paper 15, and endless belt 1. In the invention, photoreceptor 8 is negatively charged, and endless belt 1 is positively charged. If paper 15 is peeled (released from being nipped) in a state that the leading edge of paper 15 sticks to photoreceptor 8, discharge occurs in the gap between paper 15 and endless belt 1, so that paper 15 is positively charged and sticks to photoreceptor 8. If the leading edge of paper 15 sticks to endless belt 1, discharge occurs in the gap between paper 15 and photoreceptor 8, so that paper 15 is negatively charged and thus sticks to endless belt 1.

Figure 1:
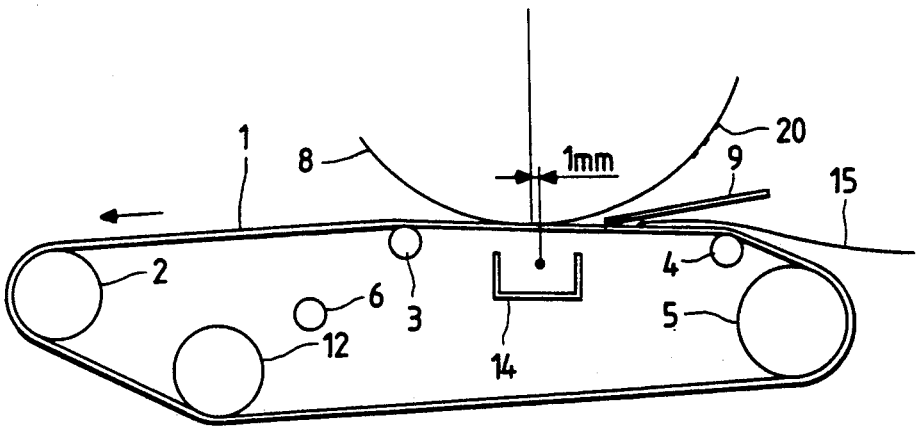
FIG. 1 is a sectional view showing a transfer unit for a xerographic printing machine according to the preferred embodiment of the present invention.
Figure 2:
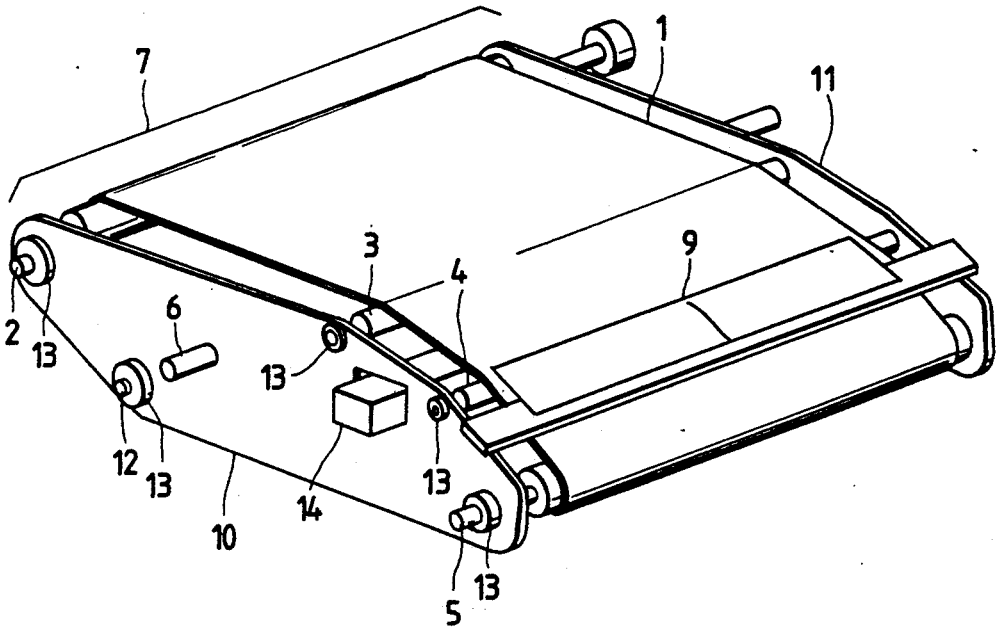
FIG. 2 is a perspective view showing the transfer unit for the xerographic printing machine shown in FIG. 1.
Figure 3:
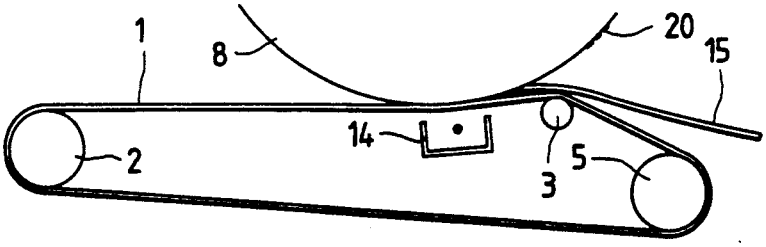
FIG. 3 PRIOR ART
FIG. 3 is a sectional view showing the internal structure of a conventional transfer unit for a xerographic printing machine.
Figure 4:
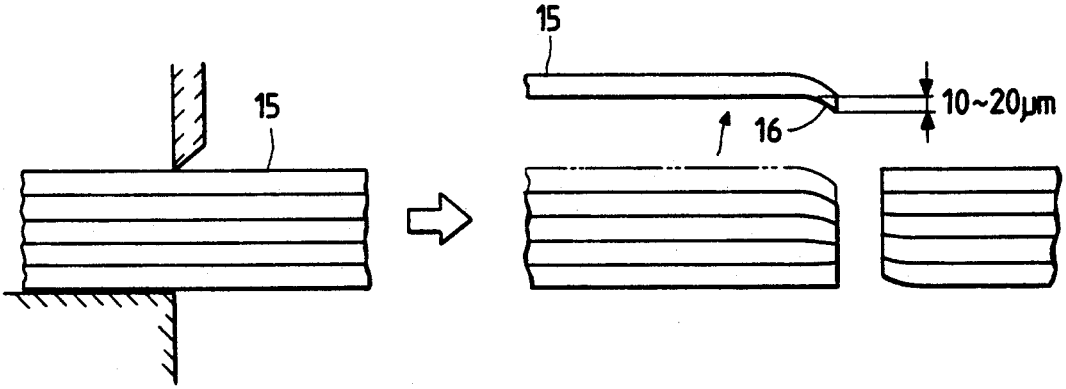
FIG. 4 PRIOR ART
FIG. 4 shows diagrams showing how a stack of papers is cut out.

FIG. 1 is a sectional view showing transfer unit for a xerographic printing machine according to the preferred embodiment of the present invention. FIG. 2 is a perspective view showing the transfer unit for the xerographic printing machine shown in FIG. 1. Endless belt 1 is supported by drive roller 2 and follower rollers 3, 4, 5, and 12. Drive roller 2 is rotatably mounted to side plates 10 and 11 by means of bearings 13. These components constitute transfer unit 7.

Transfer unit 7 is rotatable about shaft 6, and is driven by a driver, not shown. When driven, transfer unit 7 turns to bring endless belt 1 into, or out of, contact with photoreceptor 8, depending on the direction of rotation. In the experiment conducted by the applicant, the nip width was 6 mm long when photoreceptor 8 comes into full contact with endless belt 1.

Charge means 14 is disposed opposite to photoreceptor 8 so that endless belt 1 is located therebetween. In the experiment, charge means 14 was located about 1 mm upstream of the center of the nip part between endless belt 1 and photoreceptor 8. Also, guide member 9 is mounted on transfer unit 7 such that a contact point of guide member 9 and endless belt 1 is about 10 mm away from the end of the nip part.

With such a construction, endless belt 1 comes into contact with photoreceptor 8, in a print mode, wherein toner particles 20 are transferred from photoreceptor 8 to print media 15 and is driven so as to turn in the direction of the arrow in FIG. 1. Under this condition, print media 15, such as paper, is supplied to the machine, from a paper supply unit, not shown. Print media 15 is led along the surface of endless belt 1, and the leading edge of print media 15 reaches the contact point of belt 1 and guide member 9, so as to be pressed against the surface of endless belt 1 by guide member 9.

Then, print media 15 is nipped between endless belt 1 and photoreceptor 8. In the process of nipping print media 15, gap discharge occurs between print media 15 and photoreceptor 8, so that print media 15 is electrostatically brought into contact with endless belt 1. As discussed above, the charge on, and thus, the adhesion of, print media 15 around photoreceptor 8 depends on whether the leading edge of print media 15 comes into first contact with photoreceptor 8 or endless belt 1.

Figure 5A:
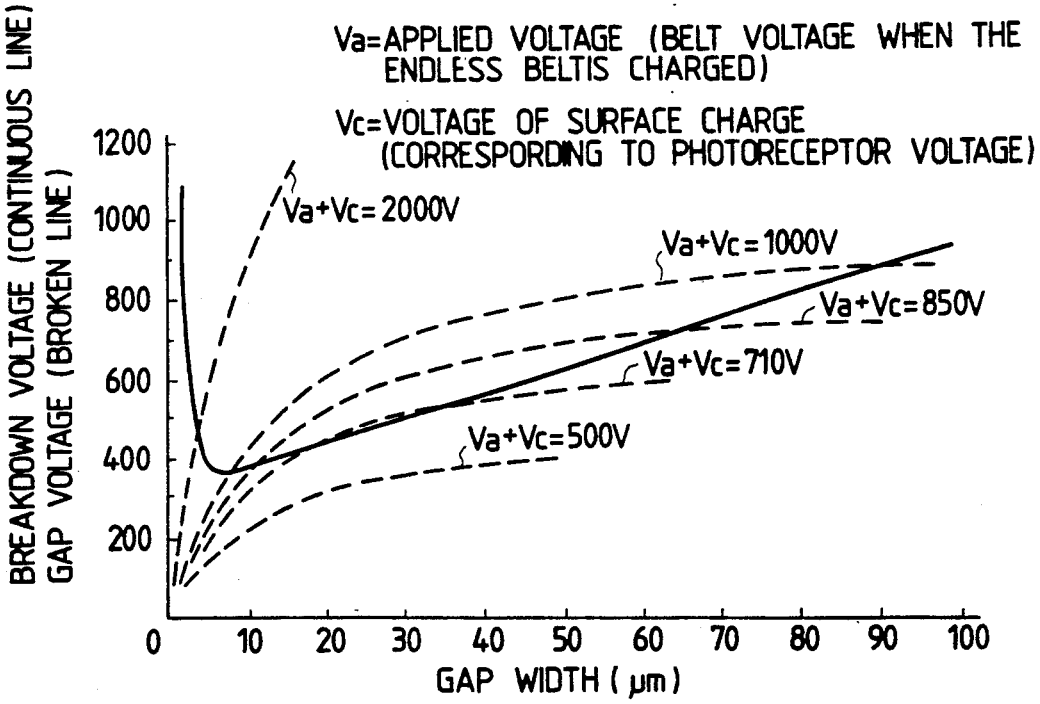
FIG. 5(a) PRIOR ART
FIG. 5(*a*) is a graph showing the Paschen curve (indicated by a solid line) under atmospheric pressure, and typical gap-voltage vs. gap width curved (indicated by dotted lines) between two dielectric sheets with fixed quantities of charge.
Figure 5B:
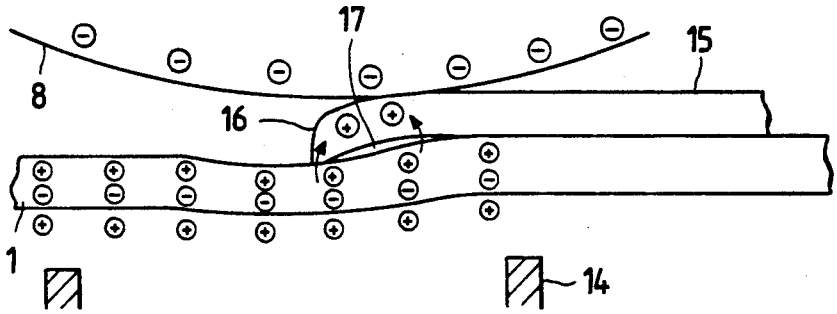
FIG. 5(b) PRIOR ART
Figure 5C:
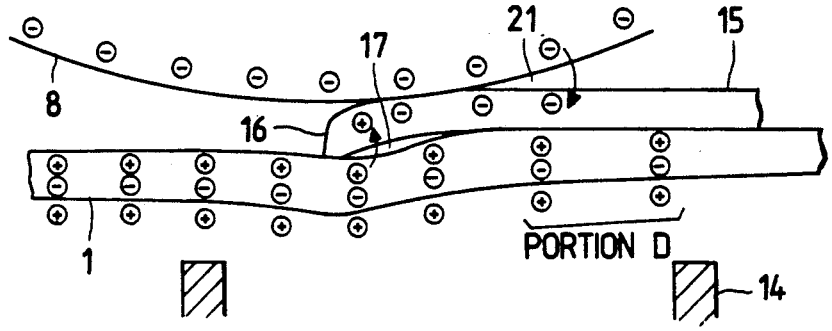

A degree of the contact of the leading edge of print media 15 depends largely on burr 16. If print media 15 is set such that burr 16 of the paper leading edge is outcurved toward endless belt 1, a gap is formed between endless belt 1 and print media 15 before it is released from the nipped state, as shown in FIG. 5(b). Discharge occurs in the gap, and the leading edge of print media 15 is positively charged. Therefore, print media 15 is peeled from endless belt 1 while it sticks to photoreceptor 8. To avoid this, it is necessary to negatively charge print media 15 to reduce the attracting force between print media 15 and photoreceptor 8. Meanwhile, the gap discharge occurs not only when print media 15 is released from the nipped state, but also when it enters the nip part. Accordingly, the gap discharge between print media 15 and photoreceptor 8 acts to charge print media 15 with such a polarity so as to reduce the attracting force between paper 15 and photoreceptor 8. For this reason, the present invention charge means 14 is disposed proximate the entrance to the nip part so that print media 15 is pressed against endless belt 1, and gap discharge occurs in gap 21 formed between print media 15 and photoreceptor 8 because gap 21 is larger than gap 17 formed between belt 1 and print media 15 by burr 16. With the attendant increase of the potential of endless belt 1 at portion D in FIG. 5(*c*), print media 15 is negatively charged to reduce the attracting force between the leading edge of print media 15 and photoreceptor 8, thereby weakening the attractive forces between paper 15 and photoreceptor 8.

As seen from the foregoing description, in the present invention, print media 15, even if it has burr 16 at the leading edge, may be charged so as to electrically stick to endless belt 1. Accordingly, the present invention successfully provides a xerographic printing machine which minimizes the sticking of the paper to the photoreceptor, without relying on measures employed in conventional devices, such as reducing the diameter of the photoreceptor or using a pawl to peel the paper off the photoreceptor.

While there has been described what is at the present considered to be the preferred embodiment of the invention, it will be understood by those skilled in the art that the foregoing and other changes in form and details can be made therein without departing from the scope of the invention.

What is claimed is:

1. A xerographic printing machine, comprising:

at least two rollers disposed so as to have their axes of rotation arranged parallel to each other;

an endless belt, supported by said rollers;

a photoreceptor disposed adjacent to said endless belt;

means for electrically charging said endless belt disposed opposite said photoreceptor so that said endless belt is located between said charging means and said photoreceptor, whereby an electrostatically charged toner supported on a surface of said photoreceptor is transferred to a print media by virtue of an electric field generated by said charging means;

a guide member disposed between said photoreceptor and one of said rollers located upstream of said photoreceptor, as viewed in the advancing direction of said endless belt, and positioned in an area along said belt that is subject to said electric field so as to bring said print media into contact with said endless belt, said guide member creating a gap between said print media and said photoreceptor, in said area, so as to cause a discharge to occur between said photoreceptor and said charging means in said area.

2. The xerographic printing machine according to claim 1, wherein an edge of said guide member, which is proximate said photoreceptor, is in contact with a surface of said endless belt.

3. The xerographic printing machine according to claim 2, wherein said charging means is disposed so that a phantom line, connecting the center of said charging means to the center of said photoreceptor, is positioned in the region ranging from a start point of a contact area of said photoreceptor and said endless belt, to the center of said contact area.

4. The xerographic printing machine as claimed in claim 1, wherein said endless belt has a volume electrical resistance within the range of $10^9$ to $10^{14}$ $\Omega$ cm, inclusive.

* * * * *